US006485266B2

(12) United States Patent
DeRuyter

(10) Patent No.: US 6,485,266 B2
(45) Date of Patent: Nov. 26, 2002

(54) COMPRESSOR ASSEMBLY WITH DEFLECTOR

(75) Inventor: Craig DeRuyter, Oostburg, WI (US)

(73) Assignee: Thomas Industries, Inc., Sheboygan, WI (US)

( * ) Notice: Subject to any disclaimer, the term of this patent is extended or adjusted under 35 U.S.C. 154(b) by 0 days.

(21) Appl. No.: 09/799,780

(22) Filed: Mar. 6, 2001

(65) Prior Publication Data

US 2001/0036410 A1 Nov. 1, 2001

Related U.S. Application Data

(60) Provisional application No. 60/188,501, filed on Mar. 10, 2000.

(51) Int. Cl.[7] ..... F04B 23/14
(52) U.S. Cl. ..... 417/201; 417/415
(58) Field of Search ..... 417/201, 366, 417/368, 415

(56) References Cited

U.S. PATENT DOCUMENTS

| | | | | | |
|---|---|---|---|---|---|
| 2,106,488 | A | * | 1/1938 | McCune | 417/273 |
| 2,107,644 | A | * | 2/1938 | Ohmart | 137/53 |
| 2,236,111 | A | * | 3/1941 | Philipp | 417/201 |
| 3,981,631 | A | | 9/1976 | Kemp | 417/312 |
| 4,032,261 | A | * | 6/1977 | Madan | 417/366 |
| 4,190,402 | A | | 2/1980 | Meece et al. | 417/415 |
| 4,350,475 | A | | 9/1982 | Meece et al. | 417/238 |
| 4,492,533 | A | * | 1/1985 | Tsuge | 417/415 |
| 4,834,626 | A | * | 5/1989 | Prevosto | 417/415 |
| 5,137,434 | A | * | 8/1992 | Wheeler et al. | 417/415 |
| 5,152,677 | A | | 10/1992 | Bauer et al. | 417/366 |
| 6,227,821 | B1 | * | 5/2001 | Leu et al. | 417/415 |

FOREIGN PATENT DOCUMENTS

| | | | |
|---|---|---|---|
| CH | 617 986 | 6/1980 | F04B/39/00 |
| EP | 335 362 | 10/1989 | F04B/39/06 |

* cited by examiner

*Primary Examiner*—Charles G Freay
*Assistant Examiner*—John F Belena
(74) *Attorney, Agent, or Firm*—Quarles & Brady LLP

(57) ABSTRACT

A compressor assembly which includes a housing having an air inlet. A cylinder sleeve having an end open into the housing receives a piston disposed in the housing. The piston extends into the cylinder sleeve open end for reciprocal movement in the sleeve. A fan fixed relative to the housing causes air to flow through the inlet toward the piston. A deflector is interposed between the piston and the inlet, wherein the deflector prevents air flowing through the inlet from impinging directly onto the piston.

6 Claims, 6 Drawing Sheets

COMPRESSOR ASSEMBLY WITH DEFLECTOR

CROSS REFERENCES TO RELATED APPLICATIONS

This application claims priority to U.S. Provisional Patent Application No. 60/188,501 filed on Mar. 10, 2000.

STATEMENT REGARDING FEDERALLY SPONSORED RESEARCH

Not Applicable

Background of the Invention

This invention relates to piston pumps and compressors, and more particularly to an air cooled, piston compressor.

In a typical air cooled, piston compressor, a housing encloses a piston reciprocating in a cylinder sleeve to compress air. Air is compressed by the piston which draws air into the cylinder sleeve in a downstroke, and forces the air out of the cylinder sleeve in an upstroke. The air passes through a valve assembly mounted to the cylinder sleeve top which directs the flow of air through the cylinder. A fan draws cooling air into the housing to cool the piston and cylinder sleeve.

The piston reciprocates in the cylinder sleeve with a seal material mounted thereon which establishes a sliding seal with the interior of the cylinder sleeve. The seal can pick up contaminants which collect on the cylinder sleeve interior surface. These contaminants can work their way up the inside of the cylinder sleeve and into the compression chamber, damaging the cylinder sleeve, piston seal material, and fouling the compressed air.

The fan draws contaminants into the housing with the cooling air. These contaminants are propelled by the fan, and can impinge directly onto the reciprocating piston and lower portion of the cylinder sleeve, thus increasing the potential for damage to the compressor. Therefore a need exists to protect the piston and cylinder sleeve from contaminants propelled into the housing by the fan.

SUMMARY OF THE INVENTION

The present invention provides a compressor assembly which includes a housing having an air inlet. A cylinder sleeve having an end open into the housing receives a piston disposed in the housing. The piston extends into the cylinder sleeve open end for reciprocal movement in the sleeve. A fan fixed relative to the housing causes air to flow through the inlet toward the piston. A deflector is interposed between the piston and the inlet, wherein the deflector prevents air flowing through the inlet from impinging directly onto the piston.

A general objective of the present invention is to prevent contaminants from impinging directly on the reciprocating piston or inside the cylinder. This objective is accomplished by positioning a deflector between the cooling air inlet and piston/cylinder to shield the piston and cylinder sleeve from contaminants propelled by the fan.

The foregoing and other objects and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENT

Figure 1:
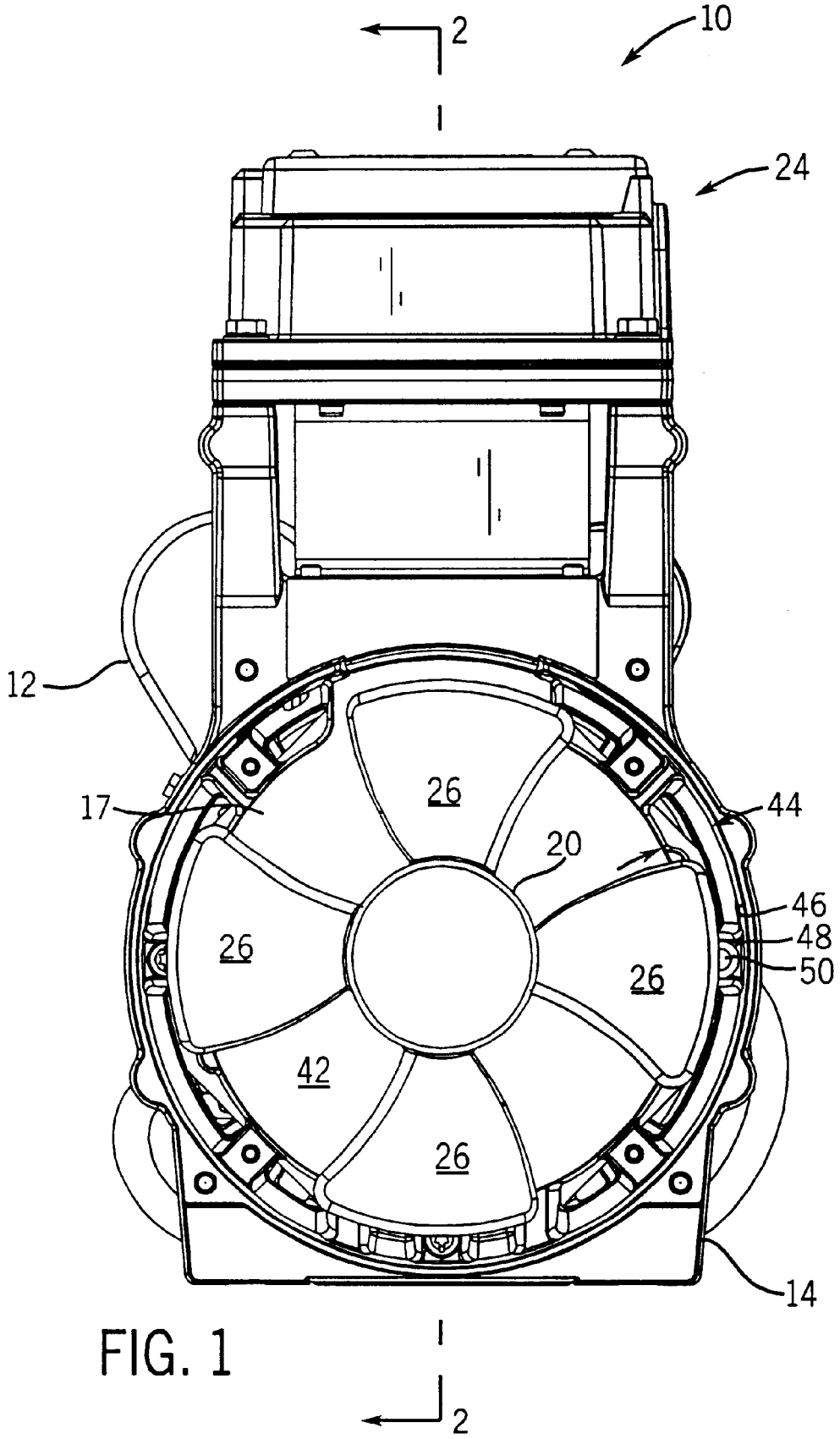
FIG. 1 is a front view of a single cylinder compressor incorporating the present invention.
Figure 2:
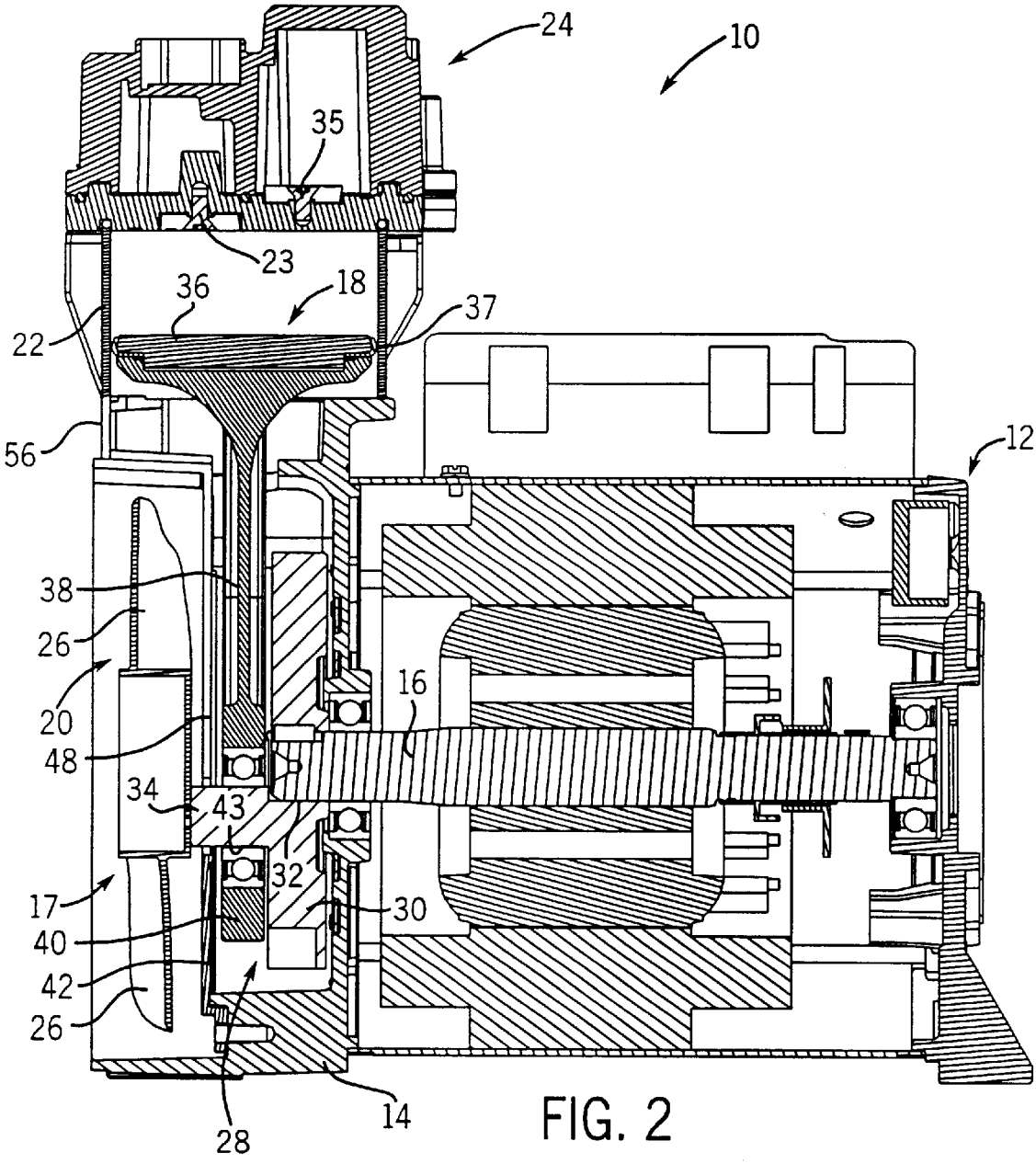
FIG. 2 is a cross sectional view along line 2—2 of the compressor of FIG. 1.
Figure 3:
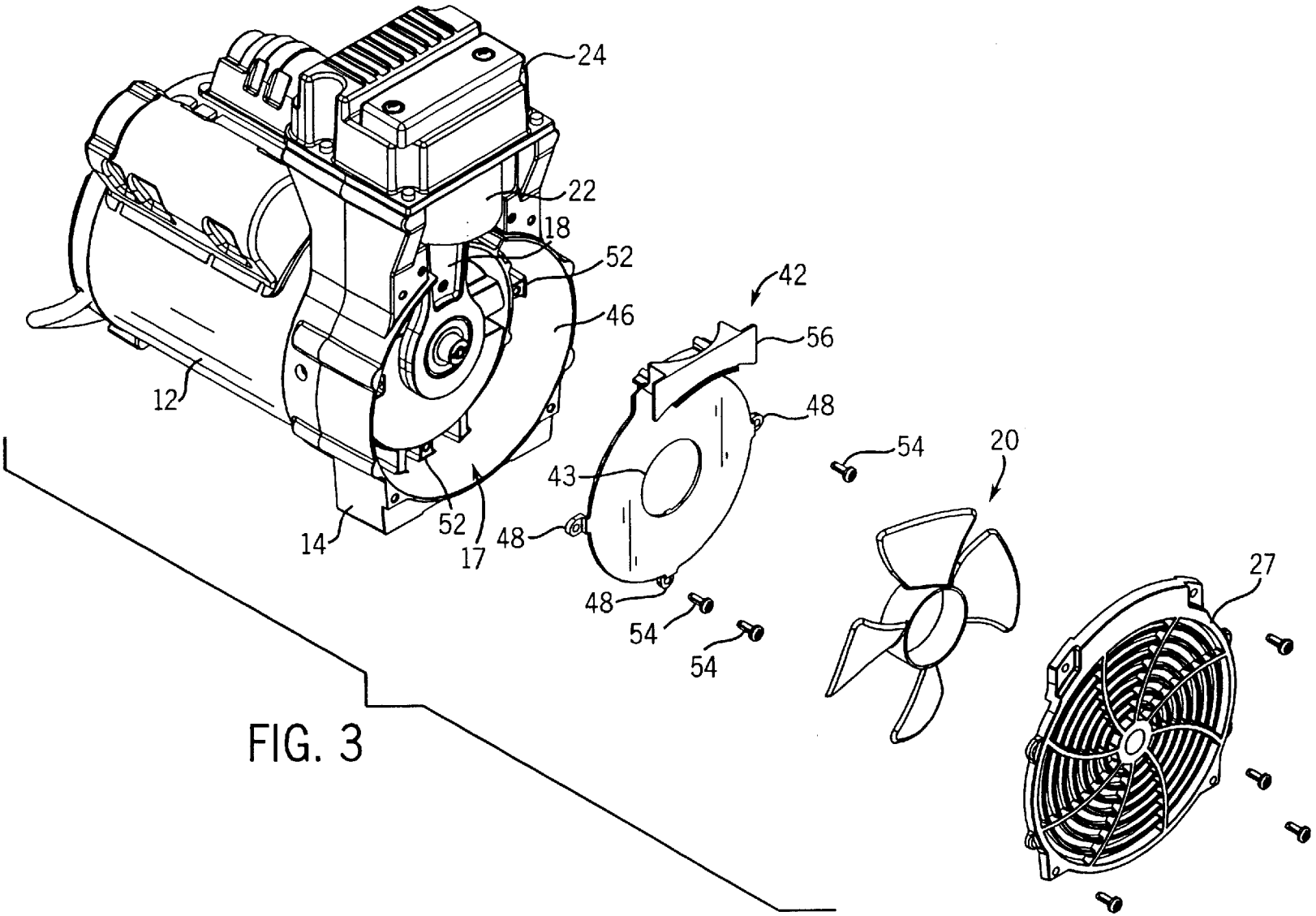
FIG. 3 is an exploded view of the compressor of FIG. 1.

A compressor assembly 10, shown in FIGS. 1–3, includes an electric motor 12 mounted to a compressor housing 14. The motor 12 has a rotatable shaft 16 which extends into the housing 14 to drive a reciprocating wobble piston 18 and a fan 20. The housing 14 encloses the piston 18 which extends into a cylinder sleeve 22. The shaft 16 eccentrically drives the piston 18 which reciprocates in the cylinder sleeve 22 to compress air. Air is drawn into, and expelled from, the cylinder sleeve 22 by the piston 18 through a valve assembly 24.

The piston 18, cylinder sleeve 22, valve assembly 24, and fan 20 are known in the art, such as used in Thomas Industries compressors Model Nos. TG-280, T-200, and as disclosed in U.S. Pat. No. 4,190,402 which is fully incorporated herein by reference. Although an electric motor is disclosed, other methods know in the art for rotatably driving a shaft may be used without departing from the scope of the invention. For example, an internal combustion engine having a rotatable shaft can be used to drive the piston 18.

The motor 12 drives an eccentric assembly 28 connected to the piston 18 to cause the piston 18 to reciprocate in the cylinder sleeve 22. The eccentric assembly 28 has a connecting block 30 with a bore 32 formed therein which receives an end of the motor shaft 16. The shaft 16 is fixed in the bore 32 using methods known in the art, such as a screw, to prevent rotation of the shaft 16 in the bore 32. A pin 34 offset from the bore 32 engages the piston 18, such that rotation of the shaft 16 drives the piston 18 in an inwardly and outwardly reciprocating motion in the cylinder sleeve 22 to cause alternating suction and compression.

The wobble piston 18 includes a cup retainer 36 extending into the cylinder sleeve 22, and connecting rod 38. As shown in FIG. 2, the piston 18 reciprocates in the cylinder sleeve 22 with a seal material 37 sandwiched between the cup retainer 36 and the rod 38. The seal material 37 establishes a sliding seal with the interior of the cylinder sleeve 22.

The connecting rod 18 has a cup retainer end rigidly connected to the cup retainer 36, such as by a screw, and a connecting end 40. The connecting end 40 includes a bore 43 for engaging the pin 34 extending from the eccentric assembly 28. The pin 34 rotates in the connecting rod bore 43, as it orbits around the shaft 16 axis. Because the piston cup retainer 36 is fixed to the connecting rod 38, the cup retainer 36 also wobbles inside the cylinder sleeve 22.

The valve assembly 24 is mounted on the top of the sleeve 22, and includes inlet 23 and discharge 25 valves. The valves 23, 25 allow air to be drawn into the cylinder sleeve 22 when the piston 18 is moving in an outwardly direction (away from the valve assembly 24), and channels compressed air out of the cylinder sleeve 22 when the piston 18 is moving in an inwardly direction (toward the valve assembly 24).

The fan 20 is mounted to the eccentric assembly pin 34, and draws cooling air into the housing 14 through an air inlet 17 to cool the piston 18 and cylinder sleeve 22. The fan 20 is rotatably driven by the eccentric assembly 28, and thus the motor shaft 16, and has blades 26 which draw the air into the housing 14. Although an axial fan is shown, other fans, such as a centrifugal fan may be used. A grill 27 mounted to the housing 14 over the air inlet 17 encloses the fan 20 in the housing 14.

A deflector 42 interposed between the fan 20 and piston 18 protects the piston 18 and cylinder sleeve 22 from contaminants drawn into the housing 14 by the fan 20. The deflector 42 is formed from a thin rigid material, such as metal or plastic, and blocks direct cooling air flow and contaminants propelled by the fan 20 from directly impinging against the piston and cylinder sleeve. Although, a deflector 42 interposed between the fan 20 and piston 18, wherein the fan 20 propels cooling air toward the piston 18, is shown, the piston can be interposed between the fan and deflector, wherein the fan draws cooling air toward the piston, without departing from the scope of the present invention.

The deflector 42 has an aperture 44 through which extends the pin 34 driving the fan, and is sized smaller than the housing interior to define a gap 44 between the deflector 42 and the housing interior wall 46. The gap 44 allows cooling air drawn into the housing 14 to flow around the deflector 42 and cool the piston 18 and cylinder 22.

Tabs 48 extending outwardly from the deflector perimeter have holes 50 which are aligned with screw bosses 52 in the housing 14. Screws 54 inserted in the holes 50 and threadably engaging the screw bosses 52 secure the deflector 42 to the housing 14. Although screws extending through tabs are shown to fix the deflector relative to the housing, other methods for fixing the deflector relative to the housing can be used, such as adhesively fixing the deflector to the housing, forming the deflector as an integral part of the housing, and the like, without departing from the scope of the present invention.

A shield 56 extending from the deflector perimeter closes the gap 44 between the fan 20 and cylinder 22 to block the cooling air flow, and thus contaminants, from impinging directly on the piston 18 and cylinder 22. The shield 56 can be shaped to fit around the lower portion of the cylinder sleeve 22, such as shown in FIG. 3, and to abut the housing 12 to provide a close fit in the area of the cylinder sleeve 22. Although a shield extending from the deflector is preferred in certain applications, the deflector and housing can be shaped such that a shield is not required. For example, the housing can include a shield which extends toward the deflector to provide a close fit in the area of the cylinder sleeve.

Figure 4:
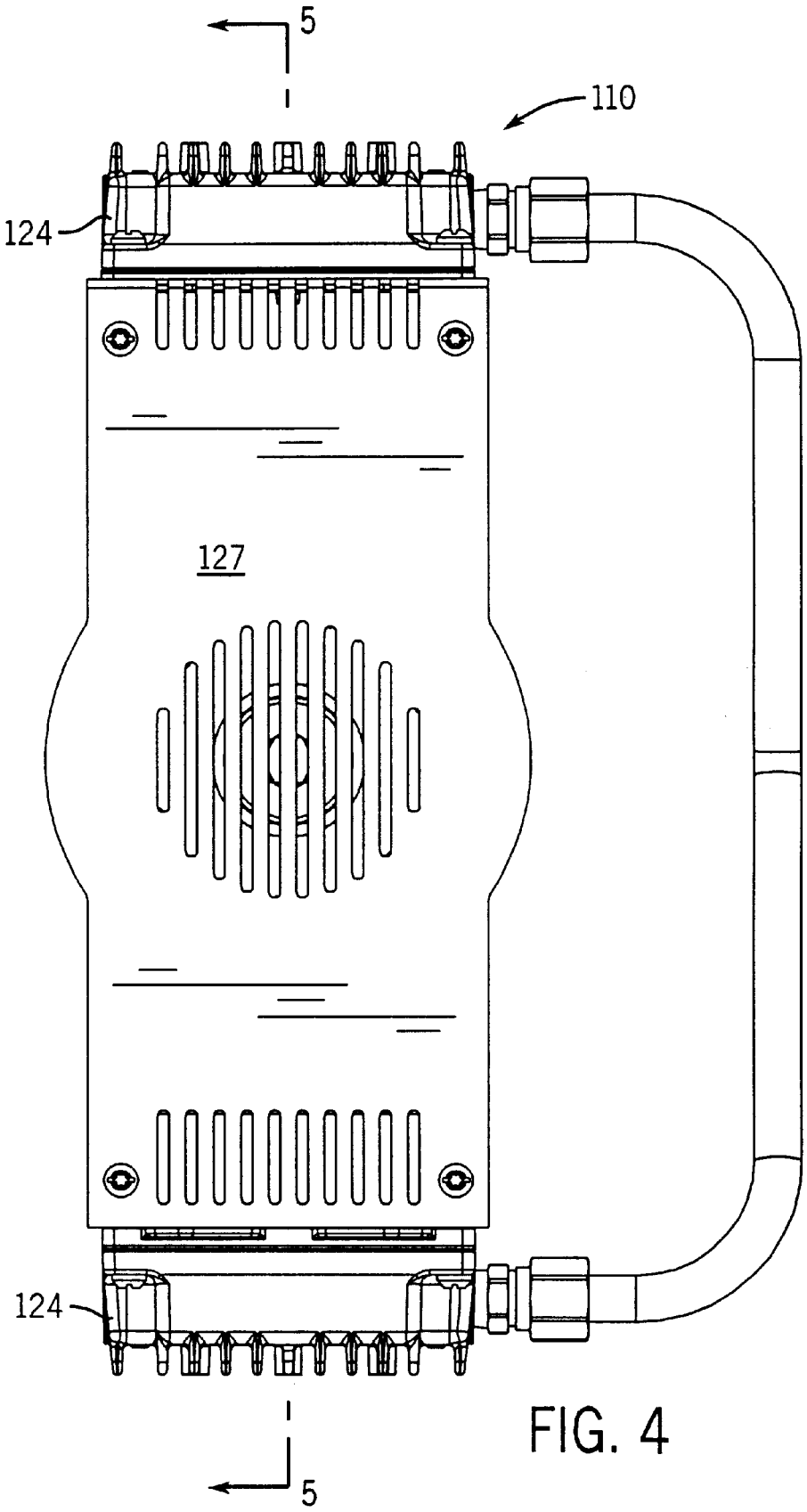
FIG. 4 is a front view of an opposing two cylinder compressor incorporating the present invention.
Figure 5:
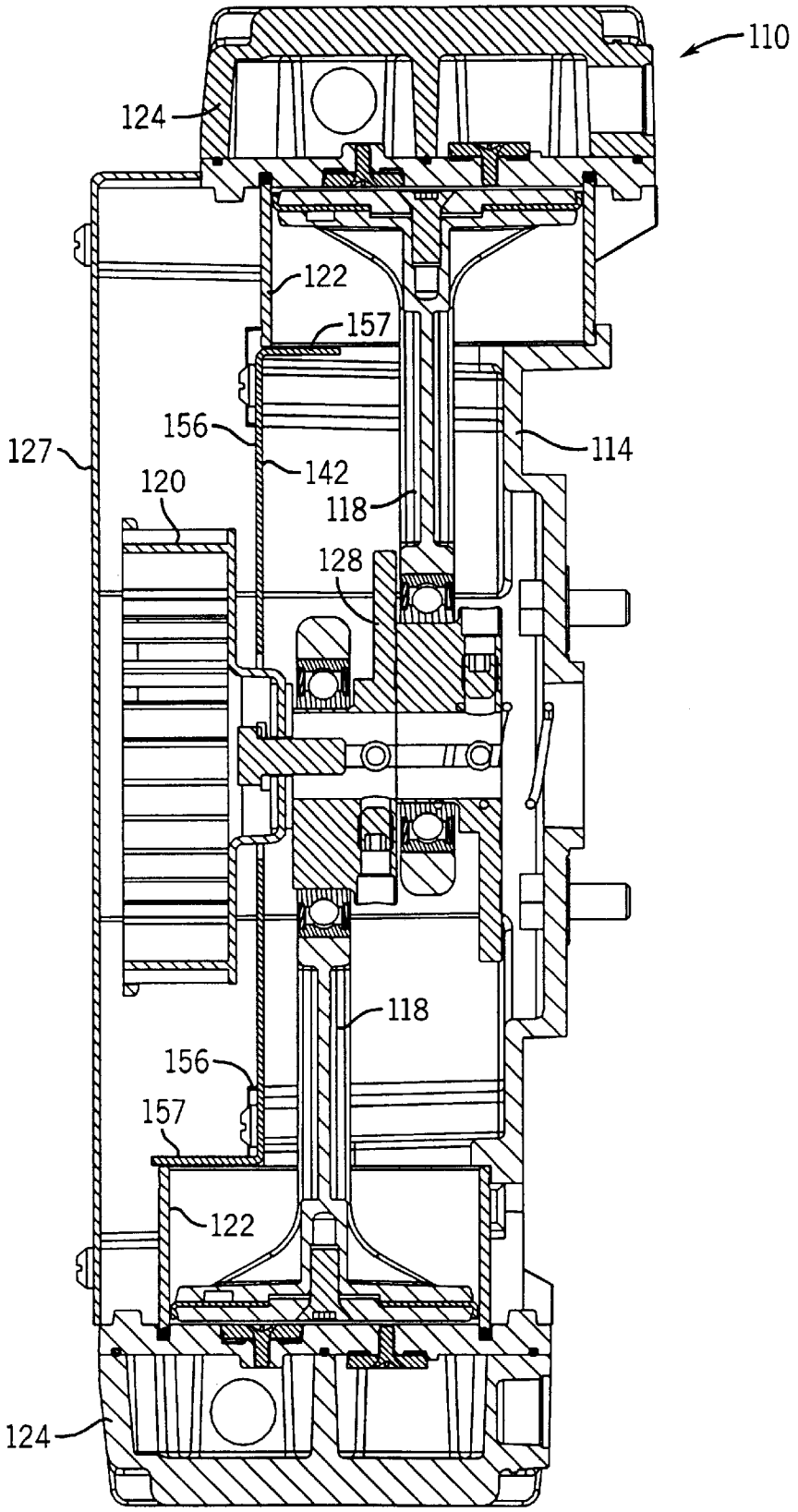
FIG. 5 is a cross sectional view along line 5—5 of the compressor of FIG. 4.
Figure 6:
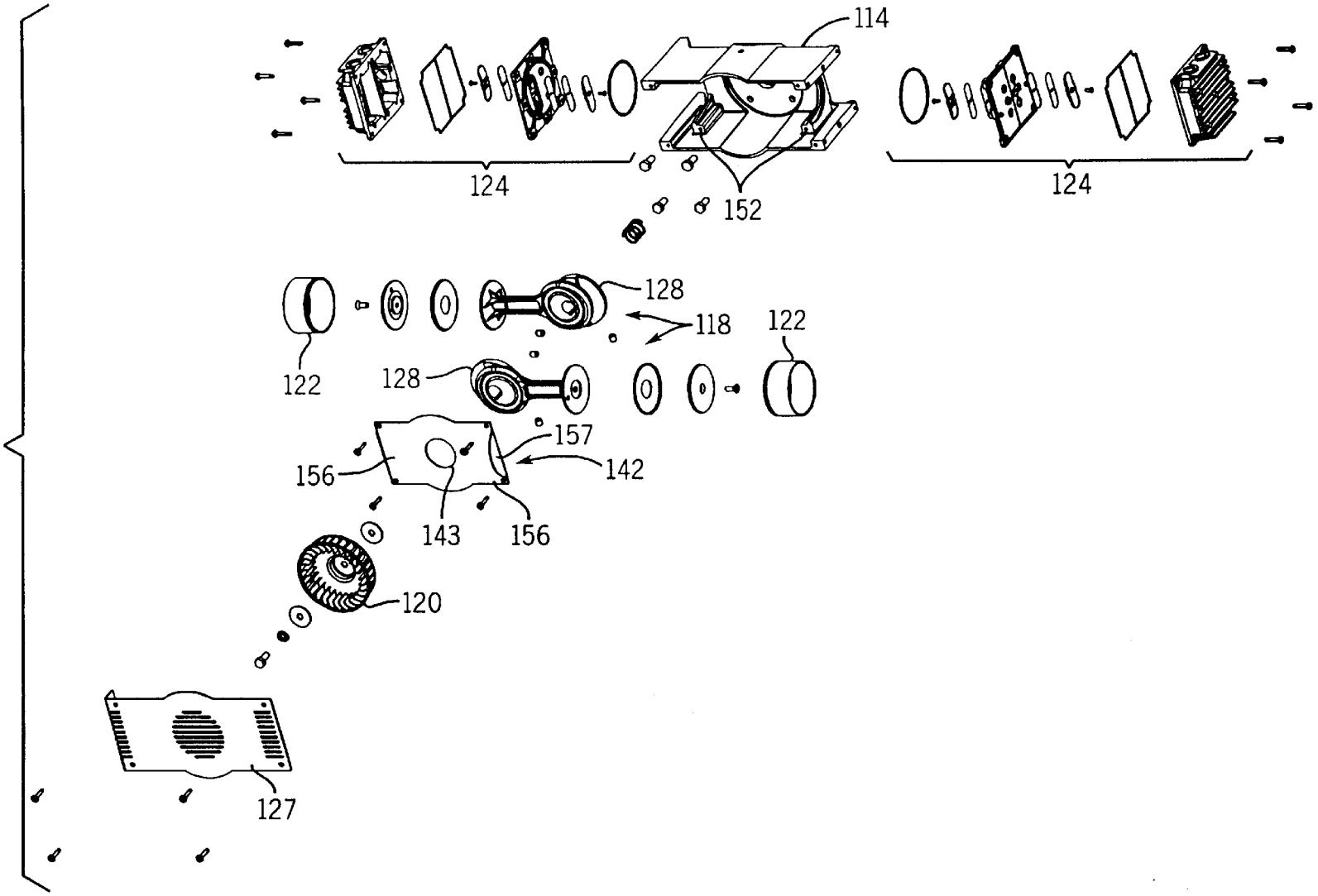
FIG. 6 is an exploded view of the compressor of FIG. 4.

A deflector can also be used to protect a multiple cylinder compressor, such as the opposing two cylinder compressor shown in FIGS. 4–6. As in the single cylinder compressor, a motor having a shaft eccentrically drives a reciprocating piston to compress air. In the opposing two cylinder compressor shown in FIGS. 4–6, the motor (not shown) includes a rotatable shaft which extends into a housing 114 to drive two opposed reciprocating wobble pistons 118 and a fan 120. The shaft drives an eccentric assembly 128 which causes the pistons 118 to reciprocate in opposing cylinder sleeves 122 to compress air. A centrifugal fan 120 is mounted to the eccentric assembly 128, and draws air into the housing 114 to cool the pistons 118 and cylinder sleeves 122. An air permeable grill 127 mounted to the housing 114 encloses the fan 120 inside the housing 114.

Referring to FIGS. 5 and 6, a deflector 142 mounted to the housing 114 between the fan 120 and the pistons 118 prevents contaminants from impinging directly onto the pistons 118 and cylinder sleeves 122. The deflector 142 has an aperture 143 through which extends a portion of the fan 120, and is sized smaller than the housing interior to define a gap between the deflector 142 and the housing interior wall. As in the embodiment disclosed above, the gap allows cooling air drawn into the housing 114 to flow around the deflector 142 and cool the pistons 118 and cylinder sleeves 122.

Shields 156 extending from the deflector perimeter close the gap between the defector perimeter and each cylinder sleeve 122 to block the air flow, and thus contaminants, from impinging directly on each piston 118 and cylinder sleeve 122. As in the embodiment disclosed above, the shields 156 can be shaped to fit around the lower portion of the cylinder sleeve 122, or to abut the housing 112, such as by forming extensions 157, to provide a close fit. Holes 150 formed in the shields 156 are aligned with screw bosses 152 in the housing 112. Screws 154 inserted in the holes 150 and threadably engaging the screw bosses 152 secure the deflector 142 to the housing 112.

While there has been shown and described what are at present considered the preferred embodiment of the invention, it will be obvious to those skilled in the art that various changes and modifications can be made therein without departing from the scope of the invention.

I claim:

1. A compressor assembly comprising:

a housing having an air inlet;

a cylinder sleeve having an end open into said housing;

a piston disposed in said housing, and extending into said cylinder sleeve open end for reciprocal movement in said sleeve;

a fan fixed relative to said housing for causing air to flow through said inlet toward said piston; and a deflector interposed between said piston and said inlet blocking air flowing through said inlet from impinging directly on at least one of an interior surface of said cylinder sleeve and said piston, said deflector defining a passageway past said deflector proximal at least one edge of said deflector adjacent said housing.

2. A compressor assembly comprising:

a housing having an air inlet;

a cylinder sleeve having an end open into said housing;

a piston disposed in said housing, and extending into said cylinder sleeve open end for reciprocal movement in said sleeve;

a fan fixed relative to said housing for causing air to flow through said inlet toward said piston; and a deflector interposed between said piston and said inlet, wherein said deflector changes the direction of the air to prevent the air flowing through said inlet from impinging directly on at least one of an interior surface of said cylinder sleeve and said piston, and air flows through a gap between at least one edge of said deflector and an interior wall of said housing to cool said piston.

3. The compressor assembly of claim 2, in which said fan is interposed between said inlet and said deflector, and said fan propels air toward said piston.

4. The compressor assembly of claim 2, in which a shield extends between a portion of said deflector edge and a portion of said housing interior wall to close a portion of said gap.

5. The compressor assembly of claim 2, in which air flows through at least one aperture formed in said deflector to cool said piston.

6. The compressor assembly of claim 1, in which said passageway is at least one gap between said deflector edge and said housing.

* * * * *